United States Patent [19]

Kanamaru et al.

[11] Patent Number: 4,884,952

[45] Date of Patent: Dec. 5, 1989

[54] VARIABLE DISPLACEMENT COMPRESSOR

[75] Inventors: Hisanobu Kanamaru, Katsuta; Kenichi Gunji, Ibaraki, both of Japan

[73] Assignees: Hitachi, Ltd., Tokyo; Hitachi Automotive Engineering, Ltd., Katsuda, both of Japan

[21] Appl. No.: 245,372

[22] Filed: Sep. 16, 1988

[30] Foreign Application Priority Data

Sep. 18, 1987 [JP] Japan ..... 62-232231

[51] Int. Cl.[4] ..... F04B 1/28

[52] U.S. Cl. ..... 417/222; 92/12.2

[58] Field of Search ..... 417/222 S, 222, 270; 92/12.2

[56] References Cited

U.S. PATENT DOCUMENTS

| | | | |
|---|---|---|---|
| 2,405,006 | 7/1946 | Ashton | 417/222 |
| 3,010,403 | 11/1961 | Zubaty | 417/269 |
| 3,129,702 | 4/1964 | Arbanas | 417/269 |
| 4,297,085 | 10/1981 | Brucken | 417/269 |
| 4,778,348 | 10/1988 | Kikuchi | 417/270 |
| 4,782,712 | 11/1988 | Takahashi | 417/269 |
| 4,801,248 | 1/1989 | Tojo | 417/269 |

*Primary Examiner*—William L. Freeh

*Attorney, Agent, or Firm*—Antonelli, Terry & Wands

[57] ABSTRACT

A variable displacement compressor comprises a plurality of pistons revived in a plurality of through-holes formed in a cylinder block arranged in a fixed relationship with a rotary shaft journaled by a stationary part, and a piston drive mechanism including a wobble plate supported on the rotary shaft for wobbling movement. The wobble plate is arranged in opposition to the cylinder block and rotatably holding one ends the pistons. The piston drive mechanism further includes a pair of drive pins having one end portion secured to the cylinder block and extending in parallel with the rotary shaft and the other end portion slidably engaging the wobble plate through spherical bearings, a swash plate having a surface making a sliding contact with a back surface of the wobble plate and supported at one part thereof for an inclination movement in an axial direction of the rotary shaft, and a piston mechanism operatively connected to the swash plate to vary an inclination angle of the latter to thereby vary an inclination angle of the wobble plate without causing rotation of the swash plate.

8 Claims, 5 Drawing Sheets

VARIABLE DISPLACEMENT COMPRESSOR

BACKGROUND OF THE INVENTION

The present invention relates to a variable displacement or capacity compressor, and more particularly to a variable displacement compressor suitable for use in an automotive vehicle.

In a conventional fluid machine, a mechanism for varying a displacement capacity is provided in a rotating member per se as shown in Japanese Unexamined Patent Publication No. 58-158382, for example. For this reason, a drive hub, a journal and the like are provided in an asymmetric relation with respect to a rotary shaft. Further, when the slant or inclination angle of a wobble plate is changed, the center of rotation of the journal is changed.

Since the rotating member of the conventional fluid machine is provided with the mechanism for varying the displacement capacity, there is caused an unbalance due to the rotation of the asymmetrically arranged components such as the drive hub and the journal. In order to cope with this, there is provided a balance weight or the like. With such structure, however, as the slant angle of the wobble plate varies, the center of rotation of the journal is displaced. Therefore, it is difficult to completely cancel or eliminate the unbalance. As a result, the unbalance becomes to be an eccentric load to increase noises and vibrations. This makes the user feel uncomfortable. In addition, the service life is shortened due to the mechanical vibrations.

U.S. Pat. No. 4,174,191 and U.S. Pat. No. 4,283,997 disclose a fluid machine in which a mechanism for varying the displacement capacity is provided in a rotating member per se as similar to the structure disclosed in the above-described Japanese Unexamined Pat. Publication No. 58-158382. Also in the structure of these U.S. Pats., it is necessary to consider keeping the balance of the rotating member.

U.S. Pat. No. 4,644,850 discloses a system in which a drive plate and a cylinder are rotated in synchronism with each other, but the system does not include a mechanism for slanting the drive plate.

SUMMARY OF THE INVENTION

An object of the invention is to provide a variable displacement compressor in which a mechanism for varying the displacement capacity is not rotated, so that the eccentric load due to rotation is eliminated to suppress generation of the noises and vibrations.

The above-described object is attained by providing a compressor in which a wobble plate supported on a rotary shaft for wobbling movement and connected to pistons is supported by a pair of drive pins secured to a cylinder block; a swash plate having a surface making a sliding contact with a back surface of the wobble plate being provided for slanting or inclination movement, and operating means for moving the swash plate to vary an inclination angle of the wobble plate.

The inclination angle of the swash plate connected to a swash plate support member through a hinge mechanism may be varied by the operation of piston mechanism provided between the swash plate and the swash plate support member without causing the rotation of the swash plate. In the case where the pressure difference between the high and low pressure chambers of the compressor, that is, in the case where it is desired to obtain a large capacity or displacement, since the pressure difference between the working chamber of the piston mechanism and the low pressure chamber is small, the force of an operating piston for moving or pushing the swash plate is small and hence the inclination of the swash plate is kept unchanged. On the other hand, in the case where the pressure difference between the high and low pressure chambers is large, that is, in the case of high speed rotation or with a sufficient cooling capacity, the difference in pressure between the working chamber and the low pressure chamber is large. Thus, the operating piston moves the swash plate forwardly, and hence the inclination angle of the swash plate becomes small and the piston stroke becomes small. Thus, the discharge capacity becomes small.

DESCRIPTION OF THE PREFERRED EMBODIMENT

The present invention will now be described by way of example with reference to the accompanying drawings.

Figure 1:
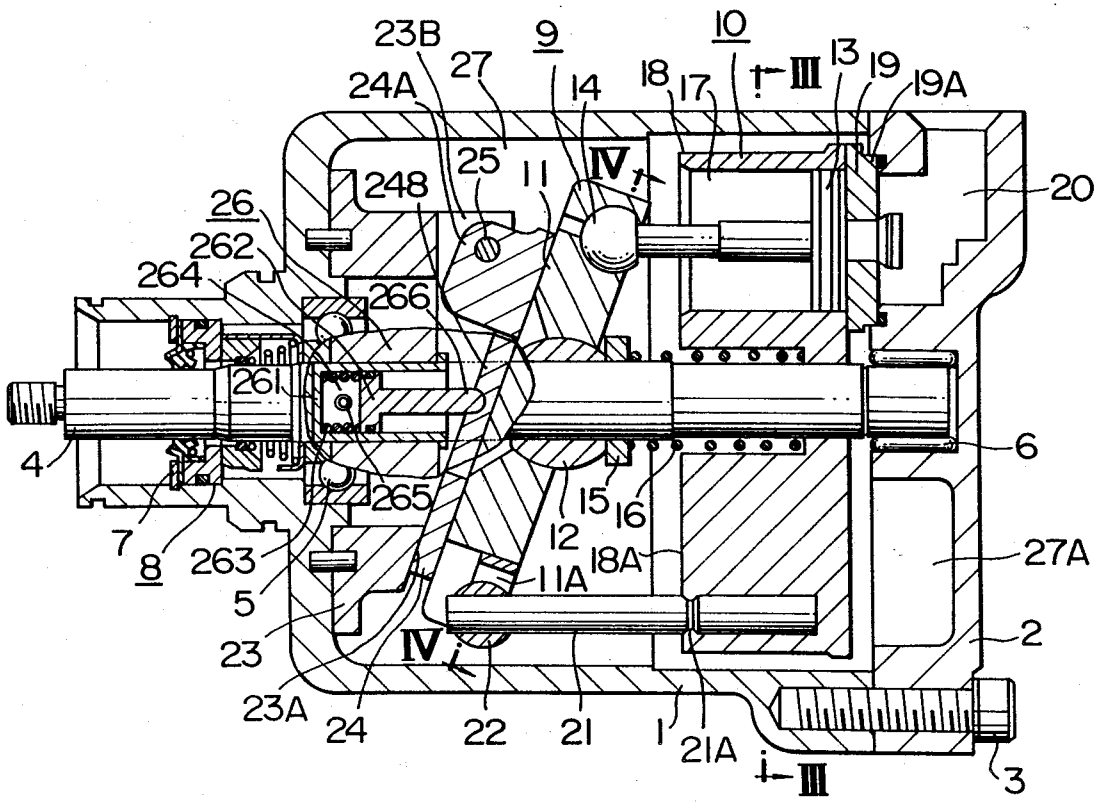
FIG. 1 is a longitudinal sectional view including a sectional view of a piston mechanism of a compressor in accordance with one embodiment of the invention.
Figure 2:
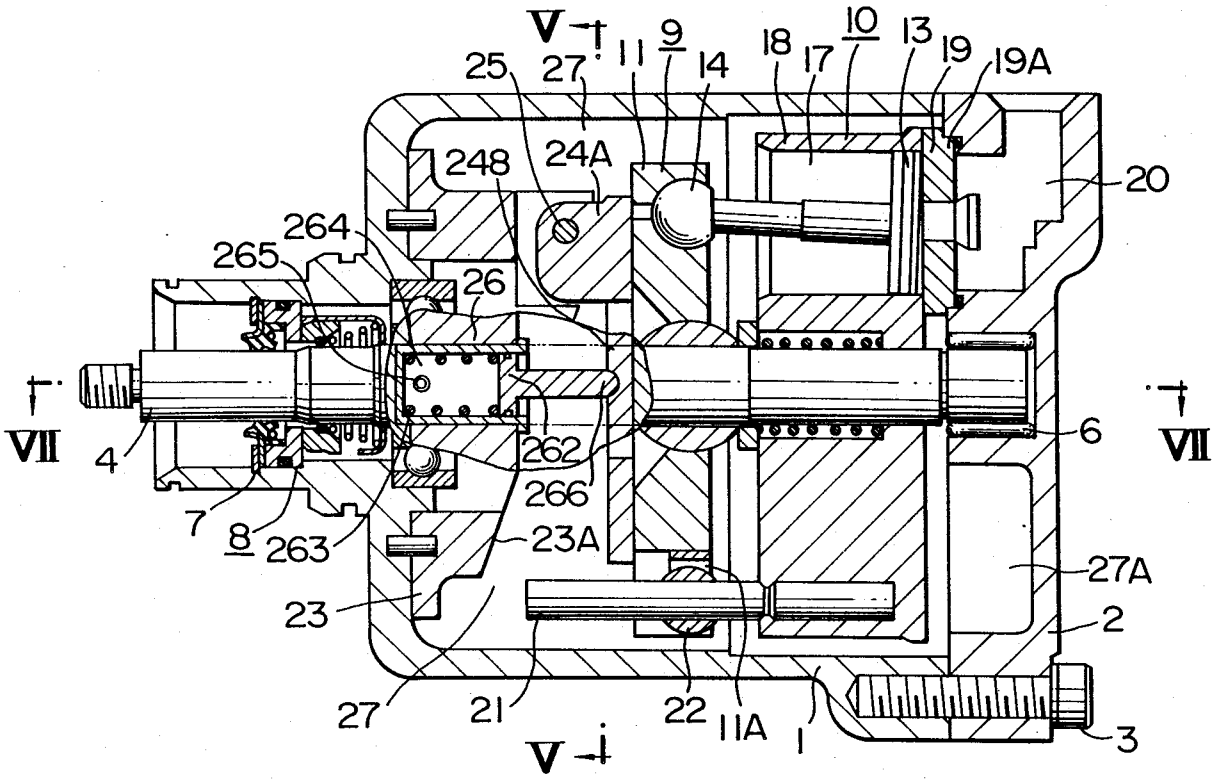
FIG. 2 is a sectional view showing the compressor shown in FIG. 1 at the operation of 0%.

Referring now to FIGS. 1 and 2, a side cover 2 made of aluminum material is fastened to an open end of a cup-shaped casing 1 made of the same material as that of the cover 2 by means of a plurality of assembling screws 3. A rotary shaft 4 is held at a central portion of the casing 1 and the side cover 2 through radial bearings 5 and 6. A mechanical seal means 8 is disposed between the casing 1 and the rotary shaft 4 and is prevented from falling apart or disassembled from the rotary shaft 4 by a clip 7.

Figure 4:
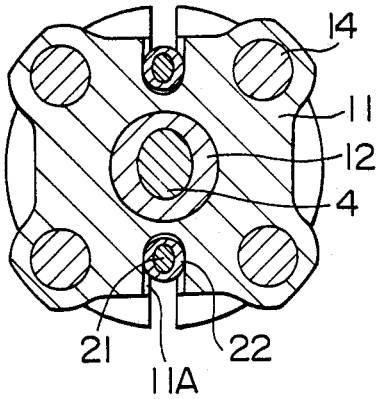
FIG. 4 is a cross-sectional view taken along the line IV—IV of FIG. 1.

Within the casing 1, there are provided a piston drive mechanism (motion conversion mechanism) 9 and a working fluid chamber assembly 10. The motion conversion mechanism 9 includes a disc-like wobble plate 11 which is rotatably supported on a center ball 12 slidably fitted at is central portion on the rotary shaft 4, and spherical portions 14 of pistons 13 are slidably held in the wobble plate 11 near the periphery of the latter, the spherical portions 14 being arranged along a circle on an inner end face of the wobble plate 11 (see FIG. 4). The center ball 12 is always pressed in the axial direction by a stopper 15 and a coil spring 16 to effect centering of the rotary plate 11.

On the other hand, the working fluid chamber assembly 10 includes a cylinder block 18 having even-numbered through-holes 17, secured at its central hollow portion onto the rotary shaft 4 and made of aluminum material; pistons 13 fitted in the through holes 17; and a cylinder head 19 having a projection 19A fitted in a high pressure chamber 20 and closing or covering the open end of the cylinder block 18.

Figure 6:
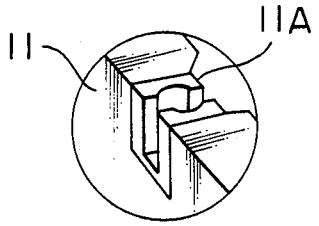
FIG. 6 is a perspective view showing a drive hole shown in FIG. 1.
Figure 7:
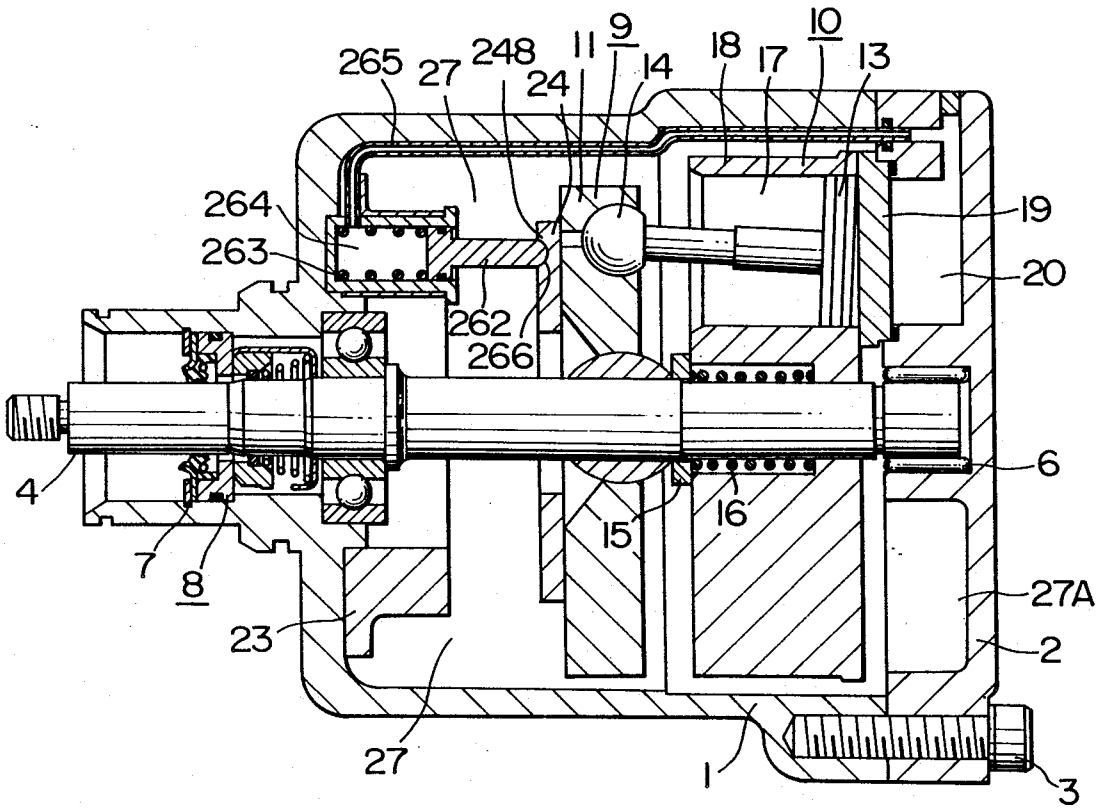
FIG. 7 is a cross-sectional view taken along the line VII—VII of FIG. 2.

Drive rods or pins 21 are fitted or implanted in the cylinder block 18. Spherical bearings 22 are slidably fitted on distal ends of the drive rods 21. The spherical bearings 22 are rotatable within drive holes 11A (see FIG. 6) formed in the wobble plate 11 and the holes 11A are movable in the radial direction relative to the bearings 22. With such structure, a torque may be transmitted from the cylinder block 18 to the wobble plate 11.

The drive pins 21 made of steel are press-inserted into the cylinder block 18 through an axially inner end face 18A of the latter. Thereafter, the portions of the cylinder block 18 around the drive pins 21 are locally, plastically deformed and the plastically deformed material is made to plastically flow into connecting grooves 21A formed in the drive pins 21. Thus, the connection at high accuracy between the driving pins 21 and the cylinder block 18 is assured.

Figure 3:
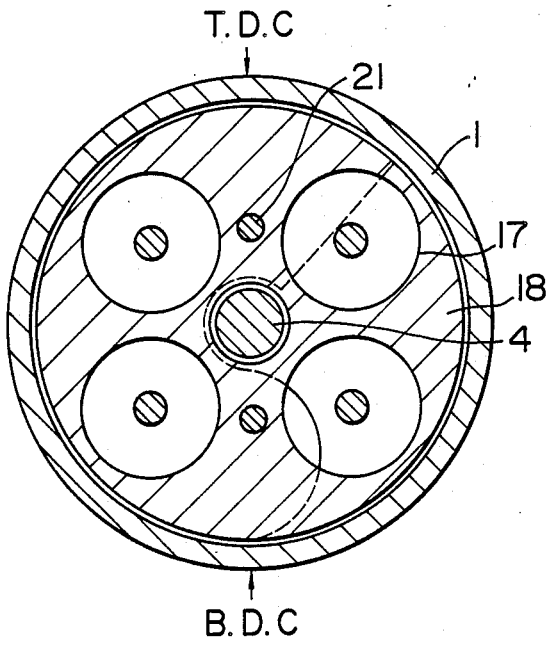
FIG. 3 is a cross-sectional view taken along the line III—III of FIG. 1.

As best shown in FIG. 3, a pair of the drive pins 21 are arranged between the even-numbered through holes 17 of the cylinder block 18 and are located in diametrically opposite relation to the center of the rotary shaft 4. The drive pins 21 are located slightly inner than the centers of the through holes 17 as measured radially outwardly from the position of the shaft 4. Thus, the length of drive pins is limited to a minimum possible level.

Figure 5:
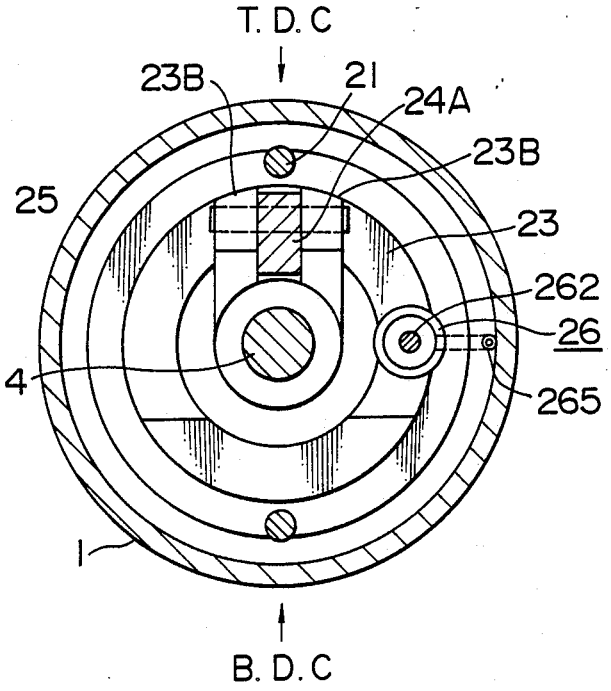
FIG. 5 is a cross-sectional view taken along the line V—V of FIG. 2.

A swash plate support member 23 having an inclination surface 23A is disposed coaxially with the rotary shaft 4 and is fixed to the inner end face of the casing 1. As best shown in FIG. 5, a bifurcated support piece 23B is formed integrally with the swash plate support member 23 on an extending plane of the inclination surface 23A. A tab 24A of a disc-shaped swash plate 24 arranged between the swash plate support member 23 and the wobble plate 11 is clamped by the bifurcated support piece 23B and is rotatably supported by a pin 25. A piston mechanism 26 is provided at that part or position of the swash plate support member 23 which is spaced apart by substantially a right angle from the support piece 23B. The piston mechanism 26 includes a bottomed sleeve member 261 installed or implanted in the swash plate support member 23, an operating piston 262 slidably fitted in the bottomed sleeve member 261 through a seal, a spring 263 for pushing or biasing the piston 262, a compression working chamber 264, and a pipe 265 for communicating the working chamber 264 with the high pressure chamber 20. A small diameter end portion 266 of the operating piston 262 is engaged with one surface of the swash plate 24 through a recess portion 24B. A low pressure chamber 27 is in communication with intake or low pressure chamber 27A.

With such an arrangement, when the rotary shaft 4 is rotated through an electromagnetic clutch by means of an internal combustion engine, for example, the cylinder block 18 is rotated, and at the same time the wobble plate 11 is rotated while receiving the drive torque from the drive pins 21. During the starting operation of the compressor, the output or discharge pressure is low and the swash plate 24 is kept in a position inclined to the maximum level and along the inclination surface 23A of the swash support member 23 as shown in FIG. 1. Thus, the pistons 13 effect apparent reciprocating movement within the through hole 17. As a result, the fluid is sucked from the low pressure chamber 27A and is compressed and discharged to the high pressure chamber 20.

The abovementioned operation relates to the case where the variation or control of the displacement capacity is not performed and a large capacity is needed. The case where the large capacity is needed corresponds to the case where the difference between the discharge pressure and the intake pressure is small. In this case, since the piston working chamber 264 of the piston mechanism 26 is in communication with the high pressure chamber 20 (discharge pressure) through the pipe 265, the difference in pressure between the operating chamber 264 and the low pressure chamber 27 (intake pressure) is small. Thus, the composite force of the force applied to the operating piston 262 due to the abovementioned pressure difference and the force of the spring 263 is smaller than the force of the spring 16.

On the other hand, in the case of the high speed rotation or in the case where the cooling capacity is sufficient, since the pressure difference between the discharge pressure and the intake pressure is large, the composite force of the force applied to the operating piston 262 due to the pressure difference and the force of the spring 263 constantly pressing the operating piston 262 against the swash plate 24 is larger than the force of the spring 16. Thus, the operation piston 262 is moved and hence the inclination angle of the swash plate 24 is continuously changed. At the minimum inclination angle, the stroke of the piston is kept at zero as shown in FIG. 2. Incidentally, at this time, since the stopper 15 is brought into contact with the cylinder block 18, the movement of the operating piston 262 is stopped. Further, since the swash plate 24 is rotated about the pin 25, the small diameter end portion 266 of the operating piston 262 and the recess portion 24B of the swash plate 24 are formed in a spherical shape.

As described above, according to the illustrated embodiment, the rotation of the cylinder block may be transmitted to the wobble plate through the pair of drive pins. Thus, it is possible to obtain a cylinder rotation type air compressor which eliminates the noises due to backlash of gears and the vibration and noise due to swing of the rotary shaft, and hence is capable of effecting quiet operation as compared with the conventional compressor incorporating therein the gear transmission mechanism.

Also, since it is possible to perform the capacity variation control by changing the inclination angle of the non-rotated swash plate as desired, the eccentric load due to the rotation is eliminated and hence it is possible to obtain a variable displacement type compressor with a high mechanical efficiency which suppresses generation of noises and vibrations.

Furthermore, since the swash plate is of the non-rotation type, it is sufficient to use a simple hinge mechanism, and it is unnecessary to provide a high mechanical strength therefor. Thus, in view of the production and assembling efficiencies, this is very advantageous.

The swash plate support member may be formed of a simple annular spacer that is a separate member from the casing, and the piston mechanism may be incorporated in the swash plate support member. Thus, it is easy to handle the assembly, and the structure is preferable in view of assembling and production efficiencies.

Also the structure of the illustrated embodiment is advantageous in that a desired variable displacement capacity mechanism may be easily obtained simply by communicating the working chamber of the piston or cylinder mechanism with the high pressure chamber through the pipe.

Although the foregoing description did not include the description on the lubricating property of the sliding surface between the swash plate 24 and the wobble plate 11, the sliding surface may be coated with fluorine resin or may be made of high oil-impregnated material.

Also, the swash plate support member may, of course, be integrally molded with the casing upon molding operation of the latter.

According to the present invention, the variable displacement capacity mechanism is provided in the cylinder block rotation type compressor, and the mechanism for varying the displacement capacity is made to be of the non-rotation type. Thus, a variable displacement capacity type compressor suppressing generation of noises and vibrations and having high mechanical efficiency may be obtained.

We claim:

1. In a variable displacement compressor comprising a rotary shaft journaled by a stationary part, a cylinder block arranged in a fixed relationship with said rotary shaft and formed with a plurality of through holes, pistons respectively received in said through holes and defining therein working fluid chambers, and piston means including a wobble plate arranged in opposition to said cylinder block and rotatably holding one end of said pistons, the compressor being constructed such that, when the cylinder block is rotated together with said rotary shaft, a fluid is sucked from a low pressure chamber into said working fluid chambers and is discharged therefrom into a high pressure chamber, the improvement comprising:

said wobble plate is supported on said rotary shaft for wobbling movement, said piston drive means further includes a pair of drive pins each having one end portion secured to said cylinder block and extending in parallel with said rotary shaft and the other end portions slidably engaging with said wobble plate through spherical bearings, a swash plate having an inclination surface making a sliding contact with a back surface of said wobble plate and supported by a swivel plate support member through a hinge mechanism at one part thereof for an inclination movement in an axial direction of said rotary shaft, said swash plate support member includes an annular spacer having one surface fixed to an inner surface of a casing and an opposite surface constituting an inclination surface, and operation means operably connected to said swash plate to move the latter for varying an inclination angle of said wobble plate, said operation means includes a piston mechanism adapted to be driven by a fluid pressure, said piston mechanism being embedded in said swash plate support member and engaging with said swash plate, said piston mechanism having a working chamber communicating with said high pressure chamber and including a piston means operated in accordance with a difference in pressure between said low pressure chamber and said high pressure chamber, and a spring for constantly biasing said piston means to closely contact said swash plate, and wherein said piston means has a smaller diameter end portion of spherical configuration which engages with a recess formed in said swash plate.

2. In a variable displacement compressor comprising a rotary shaft journaled by a stationary part, a cylinder block arranged in a fixed relationship with said rotary shaft and formed with a plurality of through holes, pistons respectively received in said through holes and defining therein working fluid chambers, and piston drive means including a wobble plate arranged in opposition to said cylinder block and rotatably holding one end of said pistons, the compressor being constructed such that, when said cylinder block is rotated together with said rotary shaft, a fluid is sucked from a low pressure chamber into said working fluid chamber and is discharged therefrom into a high pressure chamber, the improvement comprising:

said wobble plate is supported for wobbling movement on said rotary shaft through a center ball, said piston drive means further includes a pair of drive pins having one end portions implanted in those parts of said cylinder block located between said pistons and extending in parallel with said rotary shaft, said drive pins being secured in said cylinder block, spherical bearings slidably fitted on the other end portions of said drive pins and arranged in said wobble plate near a periphery of the latter in a manner to permit relative movement in a radial direction between said spherical bearings and said wobble plate, a swash plate having a surface making a sliding contact with a back surface of said wobble plate and supported at one part thereof by a swash plate support member for inclination movement in an axial direction of said rotary shaft, and piston means engaging at least a part of said swash plate located below said one part of said swash plate at which said swash plate is supported by said swash plate support member, said piston means being adapted to be operated by a fluid pressure.

3. A variable displacement compressor according to claim 2, wherein said piston means has a small diameter end portion of a spherical configuration which engages with a recess formed in said swash plate.

4. A variable displacement compressor according to claim 2, wherein said drive pins are secured in said cylinder block with a material of said cylinder block partially plastically deformed toward peripheries of said drive pins.

5. A variable displacement compressor according to claim 2, further comprising a spring arranged between said center ball and said cylinder block for constantly urging said center ball and said cylinder block to be biased in a direction away from each other.

6. A variable displacement compressor according to claim 2, wherein said piston means has a working chamber communicated with said high pressure chamber.

7. A variable displacement compressor according to claim 2, wherein said swash plate is supported by a swash plate support member having an inclination surface through a hinge mechanism.

8. A variable displacement compressor according to claim 7, wherein said swash plate support member includes an annular spacer having one surface fixed to an inner surface of a casing and an opposite surface constituting an inclination surface.

* * * * *